US007927168B2

(12) United States Patent
Takeda et al.

(10) Patent No.: US 7,927,168 B2
(45) Date of Patent: Apr. 19, 2011

(54) LOW-PRESSURE DISCHARGE LAMP AND METHOD FOR MANUFACTURING THEREOF

(75) Inventors: Yuji Takeda, Imabari (JP); Takayoshi Kurita, Imabari (JP); Masami Takagi, Imabari (JP)

(73) Assignee: Harison Toshiba Lighting Corporation, Imabari-shi, Ehime (JP)

( * ) Notice: Subject to any disclaimer, the term of this patent is extended or adjusted under 35 U.S.C. 154(b) by 42 days.

(21) Appl. No.: 12/478,194

(22) Filed: Jun. 4, 2009

(65) Prior Publication Data

US 2009/0253330 A1 Oct. 8, 2009

Related U.S. Application Data

(62) Division of application No. 10/517,388, filed as application No. PCT/JP03/07679 on Jun. 17, 2003, now abandoned.

(30) Foreign Application Priority Data

Jun. 17, 2002 (JP) ..... 2002-176269
Aug. 30, 2002 (JP) ..... 2002-255547

(51) Int. Cl.
*H01J 9/00* (2006.01)

(52) U.S. Cl. ..... 445/46

(58) Field of Classification Search ..... 445/23–25, 445/29, 46; 313/234, 607
See application file for complete search history.

(56) References Cited

U.S. PATENT DOCUMENTS

| | | | |
|---|---|---|---|
| 2,327,622 | A | 8/1943 | Craig |
| 2,756,361 | A | 7/1956 | Germeshausen |
| 4,178,059 | A | 12/1979 | Burbar et al. |
| 4,983,881 | A | 1/1991 | Eliasson et al. |
| 5,998,921 | A | 12/1999 | Nakaya et al. |
| 6,123,248 | A | 9/2000 | Tadauchi |
| 6,674,250 | B2 | 1/2004 | Cho et al. |
| 7,259,507 | B2 | 8/2007 | Kurita et al. |
| 2002/0021564 | A1 | 2/2002 | Cho et al. |

FOREIGN PATENT DOCUMENTS

| | | |
|---|---|---|
| GB | 431298 | 7/1935 |
| JP | 51-78586 | 7/1976 |
| JP | 52-65740 | 3/1997 |
| JP | 11-40109 | 2/1999 |
| JP | 11040109 A | 2/1999 |
| JP | 2000-141078 | 5/2000 |
| JP | 2000-141078 A | 5/2000 |

(Continued)

OTHER PUBLICATIONS

EP Search Report for Application No. EP 03 76 0157 dated Sep. 5, 2006.

(Continued)

*Primary Examiner* — Joseph L Williams
(74) *Attorney, Agent, or Firm* — Banner & Witcoff, Ltd.

(57) ABSTRACT

A low-pressure discharge lamp having a tubular glass lamp vessel 10, on an outer surface of which conductor layers are formed as electrodes 21 and 26. The ultrasonic solder dipping layers 31 and 36 are formed at both ends of the vessel 10 as conductor layers. The end surfaces of the glass lamp vessel are blasted and ultrasonic solder dipping layers are formed on the blasted surfaces 41 and 46 by ultrasonic solder dipping. Conductor layers form external electrodes 21 and 26, which are in contact with the glass surface more strongly. A low-pressure discharge lamp having the conductor layers of a uniform thickness can be mass-produced at low cost.

10 Claims, 2 Drawing Sheets

FOREIGN PATENT DOCUMENTS

| | | | |
|---|---|---|---|
| JP | 2002-270097 | | 9/2002 |
| KR | 1982-0002451 | Y1 | 11/1982 |
| KR | 2001-0074027 | A | 8/2001 |
| WO | 0179922 | A1 | 10/2001 |

OTHER PUBLICATIONS

KR Office Action in Application 10-2004-7020425 dated Sep. 5, 2005.

KR Office Action in Application 10-2005-7018942 dated Dec. 12, 2005.

KR Office Action in Application 10-2006-7001271 dated Aug. 29, 2006.

CN Office Action in Application No. 03814052.7 dated Sep. 8, 2006.

EPO First Communication in Application No. EP 03 760 157.2 dated Dec. 21, 2006.

EPO Communication dated May 10, 2007 in Application No. 03 760 157.2.

LOW-PRESSURE DISCHARGE LAMP AND METHOD FOR MANUFACTURING THEREOF

FIELD OF THE INVENTION

The present invention relates to a low-pressure discharge lamp and a method for manufacturing it.

BACKGROUND OF THE INVENTION

A dielectric barrier discharge type low-pressure discharge lamp having an electrode on the outer surface of a tubular glass lamp vessel (EEFL) is known as an example which is described in the laid-open Japanese utility model application Shou 61-126559, for example. This low-pressure discharge lamp is charged with ionizable filler such as rare gas or mixed gas of mercury and rare gas inside a tubular glass lamp vessel with both ends sealed. On the inner wall surface of the tubular glass lamp vessel, a phosphor layer is formed as necessary. On the outer surfaces of both ends of the tubular glass lamp vessel, external electrodes are arranged.

The external electrodes are composed of, for example, a metallic tape made of aluminum foil and a conductive adhesive for forming an electrically conductive layer and coiled lead wires connected to the metallic tape, which acts as a metal fitting for supplying the low-pressure discharge lamp with an electric power. Here, the coiled lead wires are made contact with the metallic tapes by their own elasticity.

The low-pressure discharge lamp having such a structure has an advantage that no electrode is provided in the tubular glass lamp vessel, so that no electrode consumption is caused and the life is long. However, since the diameter of the tubular glass lamp vessel is very small such as about 3 mm, a complicated machine is required to apply the metallic tape on the tubular glass lamp vessel with high dimensional accuracy and it is difficult to manufacture the discharge lamps in mass production.

Further, in an electrode using such a metallic tape, a power loss is caused in the conductive adhesive made of acrylic resin when a current flows through the metallic tape, and there is a defect of increasing in the power consumption of the lamp.

Furthermore, since the conductive adhesive has low heat resistance, it is partially carbonized due to generation of heat when the current flows, and the resistance of the part is reduced, where the current is concentrated. As a result, a problem arises that intense heat is generated, and the tubular glass lamp vessel is partially fused to form a hole.

According to embodiments of the present invention, the low-pressure discharge lamp having an electrode using a conventional metallic tape is provided, with which such technical problems as high power consumption or forming the hole of are solved and which is capable of adopting a manufacturing method for realizing mass production at low cost.

SUMMARY OF THE INVENTION

The low-pressure discharge lamp according to the present invention is characterized in that an end portion of a tubular glass lamp vessel is dipped in a solder bath in which a solder material having good contact with a glass surface is fused, and thus an electric conductor layer of an external electrode is formed. As a solder material having a good contact with the glass surface, the conductor layer becomes adhesive and strong, when any one of tin, an alloy of tin and indium or an alloy of tin and bismuth is used as a main component. The discharge characteristic of the lamp having the conductor layer is stabilized, and the life span of the lamp is lengthened.

Further, when the solder material contains at least one of antimony, zinc or aluminum as an additive, the surface of the tubular glass lamp vessel and the conductor layer have good contact with each other, with which the conductor layer is hardly separated from the surface of the tubular glass lamp vessel. Thus the discharge characteristic is stabilized and the life span of the lamp is lengthened. Moreover, when the solder dipping method is adopted to form the conductor layer, mass production can be realized and the cost can be decreased.

Further, the low-pressure discharge lamp according to the present invention is characterized in that the end portion of the tubular glass lamp vessel is dipped into an ultrasonic solder bath in which a solder material is fused, thus a conductor layer of an external electrode is formed. When any one of tin, an alloy of tin and indium, or an alloy of tin and bismuth is used as a main component of the solder material, the conductor layer becomes adhesive and strong. Thus the discharge characteristic of the lamp is stabilized, and the life span of the lamp is lengthened.

Since the conductor layer of the external electrode is formed by dipping into the ultrasonic solder bath in the low-pressure discharge lamp according to the present invention, an even layer with a uniform thickness is obtained and a highly efficient low-pressure discharge lamp can be realized. Moreover, mass production can be realized and the cost can be decreased by applying the ultrasonic solder dipping method to forming the conductor layer.

Furthermore, the low-pressure discharge lamp according to the present invention is characterized in that the surface of the end portion of the tubular glass lamp vessel is blasted and is then dipped into the ultrasonic solder bath, in which the solder material is fused, to form the conductor layer of the external electrode.

In the low-pressure discharge lamp according to the present invention, the conductor layer of the external electrode having an even layer with a uniform thickness is formed by dipping the end portion of the tubular glass lamp vessel into the ultrasonic solder bath. Moreover, the conductor layer is hardly separated from the tubular glass lamp vessel and a highly efficient low-pressure discharge lamp can be provided, since the conductor layer is formed on the blasted surface by ultrasonic solder dipping. In addition, mass production can be realized and the cost can be decreased by applying the ultrasonic solder dipping method.

Further, the manufacture of the low-pressure discharge lamps using the solder containing no lead does not give any adverse effect to the environment.

DETAILED DESCRIPTION OF THE INVENTION

Figure 1:
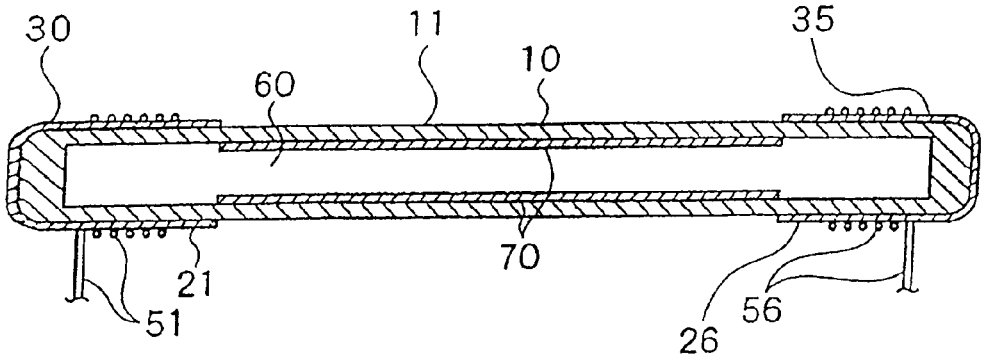
FIG. 1 is an axial cross sectional view of the dielectric barrier discharge type low-pressure discharge lamp according to a first embodiment of the present invention.

The embodiments according to the present invention will be now explained with reference to the accompanying drawings. FIG. 1 shows the structure of a dielectric barrier discharge type low-pressure discharge lamp 11 according to a first embodiment of the present invention. In the low-pressure discharge lamp 11, a tubular glass lamp vessel 10 is formed with borosilicate glass, having an outer diameter of 2.6 mm, an inner diameter of 2.0 mm, and a total length of 350 mm. The tubular glass lamp vessel 10 is charged with mixed gases of neon and argon at a charge pressure of 60 Torr (composition ratio of neon/argon is 90 mol %/10 mol %). Further, the tubular glass lamp vessel is also charged with 3 mg of mercury.

On outer surfaces of both ends of the tubular glass lamp vessel 10, solder dipping layers 30 and 35 are formed respectively as conductor layers of external electrodes 21 and 26. On an inner peripheral wall of the tubular glass lamp vessel 10 excluding the parts where the external electrodes 21 and 26 are installed, a phosphor layer 70 composed of a phosphor is formed emitting lights having three different wave lengths, i.e. R, G and B. The thickness of the phosphor layer 70 is about 20 μm.

The solder dipping layers 30 and 35 are formed by dipping the ends of the tubular glass lamp vessel 10 in a solder bath at about 350° C. where tin, zinc, aluminum, and antimony are fused for about 30 seconds. The thickness of the formed solder dipping layers 30 or 35 is about 5 μm and the length of the solder dipping layers 30 or 35 is about 20 mm. Coiled lead wires 51 and 56 are provided at the both ends of the tubular glass lamp vessel 10 where the solder dipping layers 30 and 35 are formed, which make contact with the solder dipping layers 30 and 35 with their own an elastic force.

The inventors of the patent application examined various materials for the solder material and finally confirmed that a uniform and adhesive deposit is formed on the surface of the tubular glass lamp vessel 10 by any one of solder materials of tin, an alloy of tin and indium, or an alloy of tin and bismuth. Further, the solder material containing as an additive at least one of antimony, zinc, or aluminum makes the conductor layer to be in good contact with the surface of the tubular glass lamp vessel, thereby making the conductor layer to be hardly separated, and provides the solder dipping layers 30 and 35 having a stable discharge characteristic. Namely, the solder materials containing tin and at least one of antimony, zinc, or aluminum as an additive also realize good adhesion.

Similarly, solder materials containing an alloy of tin and indium or an alloy of tin and bismuth including respectively at least one of antimony, zinc or aluminum as an additive also realize good adhesion as well as lower their melting point so that the solder dipping can be easily carried out. Further, a solder electrode can be formed, whose surface oxidation hardly proceeds, thereby forming a stable conductive electrode, when aluminum is added to tin+zinc+antimony.

Further, in the dielectric barrier discharge type low-pressure discharge lamp according to the embodiment, the voltage at the electrode hardly drops, so that the lamp voltage can be lowered compared with the conventional dielectric barrier discharge type low-pressure discharge lamp having an electrode made of the metallic tape. For example, the lamp voltage at a lamp current of 4 mA and a lighting frequency of 45 kHz is 1940 Vrms in the conventional lamp and is 1790 Vrms in the lamp according to the embodiment of the present invention.

The experiment of the inventors of the present invention revealed that a uniform solder layer cannot be formed on the surface of the vessel because some portions of the surface of the tubular glass lamp vessel 10 remained uncovered when the both ends of a tubular glass lamp vessel are dipped into a solder bath, in which an alloy of tin and copper is fused to form a deposit. Here, the alloy of tin and copper is widely used as a solder material containing no lead. Further, for a solder material composed of an alloy of tin, copper and silver, the similar results are obtained. When such a low-pressure discharge lamp 18 is kept on for many hours, a current is excessively concentrated on a part of the solder dipping layer, resulting an over heating of a part of the end portions of the tubular glass lamp vessel 10 and resulting in forming a hole, and finally a problem may arise that the lamp 18 is not kept on.

However, the solder dipping layers 30 and 35 formed on the surface of the glass lamp vessel 10 according to the embodiment of the present invention are uniform in thickness and adhesive, so that the problem of exposing the surface of the glass lamp vessel 10, which forms a base, is prevented.

Figure 2:
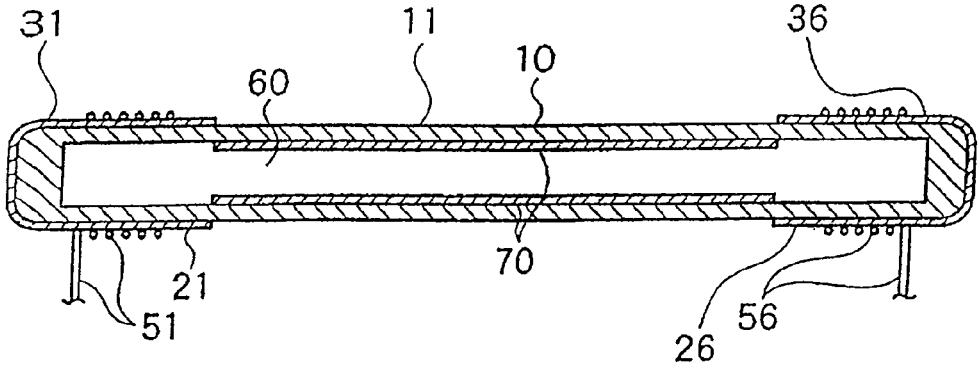
FIG. 2 is an axial cross sectional view of the dielectric barrier discharge type low-pressure discharge lamp according to a second embodiment of the present invention.

FIG. 2 shows a structure of the dielectric barrier discharge type low-pressure discharge lamp 11 according to the second embodiment of the present invention. The lamp 11 shown in the drawing has basically the same configuration as that of the discharge lamp 11 shown in FIG. 1 except for some portions. Therefore, the same numerals are assigned to the same parts and some different parts from the first embodiment will be mainly explained below. In the lamp 11, ultrasonic solder dipping layers 31 and 36 are formed on outer surfaces at both ends of the tubular glass lamp vessel 10. These ultrasonic solder dipping layers 31 and 36 are respectively used as conductor layers constituting the external electrodes 21 and 26.

Ultrasonic solder dipping, as is generally known, is a method for plating while giving ultrasonic vibration to fused solder in a bath with an ultrasonic vibrator installed in the bath. In this embodiment, the same solder material as in the first embodiment is used and the ultrasonic vibrator operates at a vibration frequency of 20 kHz. Both ends of the tubular glass lamp vessel 10 are dipped in the fused solder bath at 230° C. for about 30 seconds. Further, KDB-100 ultrasonic solder bath is used, which is manufactured by Kuroda Technology Co., Ltd.

The solder dipping layers 31 and 36 thus formed, has a thickness of 5 μm and a length of 20 mm in the axial direction of the tube as is the case with the first embodiment. The dipping layers 31 and 36 formed by dipping the tube ends into the ultrasonic solder bath have a more uniform thickness than that of the solder dipping layers 30 and 35 formed in a regular solder bath and are more adhesive to the surface of the tubular glass lamp vessel 10 as described later.

Figure 3:
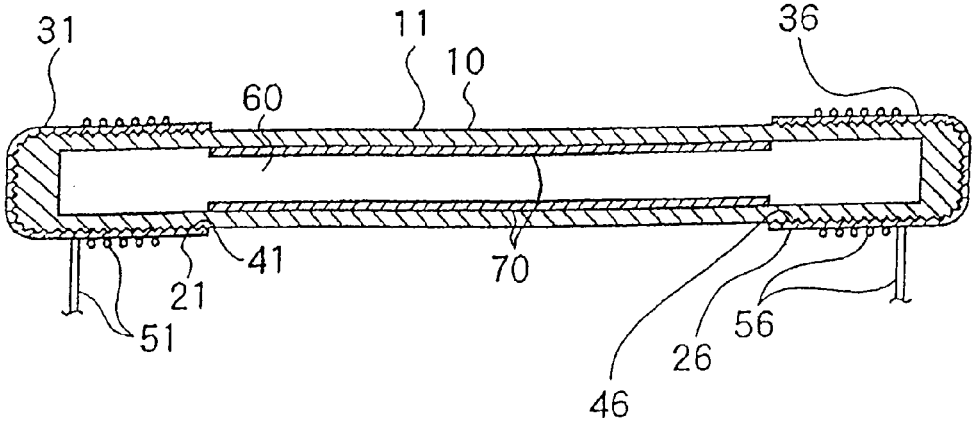
FIG. 3 is an axial cross sectional view of the dielectric barrier discharge type low-pressure discharge lamp according to a third embodiment of the present invention.

Next, the dielectric barrier discharge type low-pressure discharge lamp 11 according to the third embodiment of the present invention will be explained referring to FIG. 3. The dielectric barrier discharge type low-pressure discharge lamp 11 shown in the drawing also has the same configuration as that of the discharge lamp 11 shown in FIG. 2 as the second embodiment except for some parts thereof. Therefore, the same numerals are assigned to the same parts and the different parts from the second embodiment will be mainly explained below. In the discharge lamp 11 shown in FIG. 3, the outer surfaces of both ends of the tubular glass lamp vessel 10 are blasted to have rough surfaces. On blasted surfaces 41 and 46, thus formed, the ultrasonic solder dipping layers 31 and 36 are formed. The blasting process is performed, for example, by rotating the tubular glass lamp vessel 10 around the tube axis and spraying an alumina abrasive material on the rotating tubular glass lamp vessel 10. The blasting process can be performed by chemical etching using a fluorine acid. Both ends of the tubular glass lamp vessel 10 subjected to the blasting process are dipped into the ultrasonic solder bath under the same condition as that of the second embodiment and thus the ultrasonic solder dipping layers 31 and 36 are formed.

When the surface of the glass vessel 10 is turned into the rough surfaces 41 and 46 applying the blasting process described, the contact area between the ultrasonic solder dipping layers 31 and 36 and the glass surface of the tubular glass lamp vessel 10 is expanded and thus the ultrasonic solder dipping layers 31 and 36 can be made hardly separable.

To inspect the adhesion or separability between the ultrasonic solder dipping layers and the surface of the tubular glass lamp vessel according to the embodiment of the present invention, the inventors formed solder dipping layers using regular solder as a comparison example and executed the comparison experiment between the comparison example and the ultrasonic solder dipping layers according to the second and the third embodiment described above. Specifically, a blasted tubular glass lamp vessel and a non-blasted tubular glass lamp vessel are dipped into the solder bath to form comparison examples 1 and 2 respectively. In the solder bath, the alloy of tin and copper is fused, which is used in the aforementioned experiment by the inventors. Forming lattice scratches are formed at intervals of 1 mm on the comparison examples 1 and 2 as well as the ultrasonic solder dipping layers according to the embodiments 2 and 3 of the present invention, a heat cycle test is executed and then the separation test is executed using a cellulose tape. The test results are given in Table 1. Further, in the heat cycle, keeping each sample in an environment of 80° C. for 0.5 hours and then keeping it in an environment of −30° C. for 0.5 hours, which constitute one cycle.

TABLE 1

| | 0 cycle | 100 cycles | 200 cycles | 500 cycles |
|---|---|---|---|---|
| Electroless plated electrode (not blasted) (comparison example 1) | N.G. (even non scratched part completely separated) | | | |
| Electroless plated electrode (blasted) (comparison example 2) | OK | OK | N.G. (even non scratched part completely separated) | |
| Ultrasonic solder electrode (not blasted) (embodiment 2) | OK | OK | OK | OK |
| Ultrasonic solder electrode (blasted) (embodiment 3) | OK | OK | OK | OK |

From the results of the heat cycle test, it is confirmed that the external electrodes made of the ultrasonic solder dipping layers according to the embodiments of the present invention are stronger in the heat cycle test than the external electrodes made by the regular solder bath dipping method using an alloy of tin and copper or an alloy of tin, copper, and silver as a solder material.

Further, it is found from the difference between the embodiment 2 and the embodiment 3 that the contact area between the surface of the glass lamp vessel and the ultrasonic solder dipping layer is extended and the adhesive strength can be increased by making the smooth surface of the glass lamp vessel 10 is blasted to make it uneven as in the embodiment 3 and by forming an ultrasonic solder layer on the part blasted. Namely, by the blasting process, stronger and hardly separable external electrodes can be formed.

Figure 4:
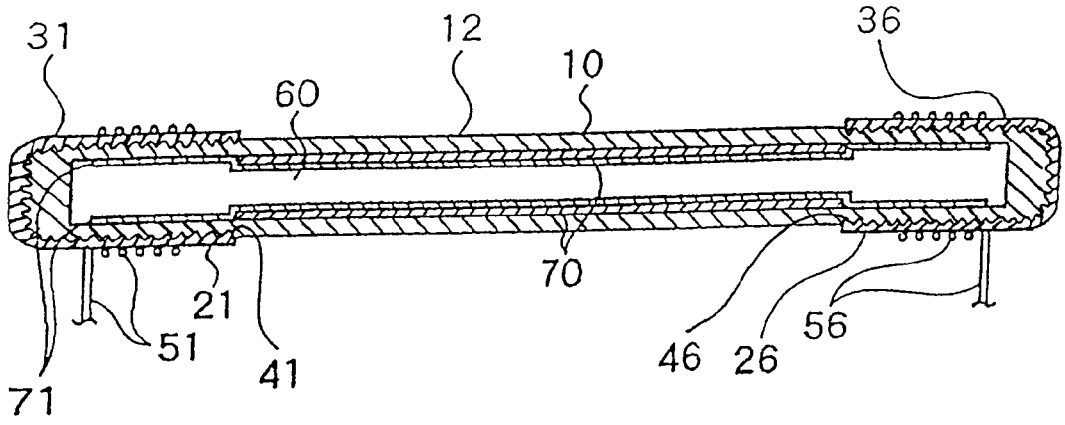
FIG. 4 is an axial cross sectional view of the dielectric barrier discharge type low-pressure discharge lamp according to a fourth embodiment of the present invention.
Figure 5:
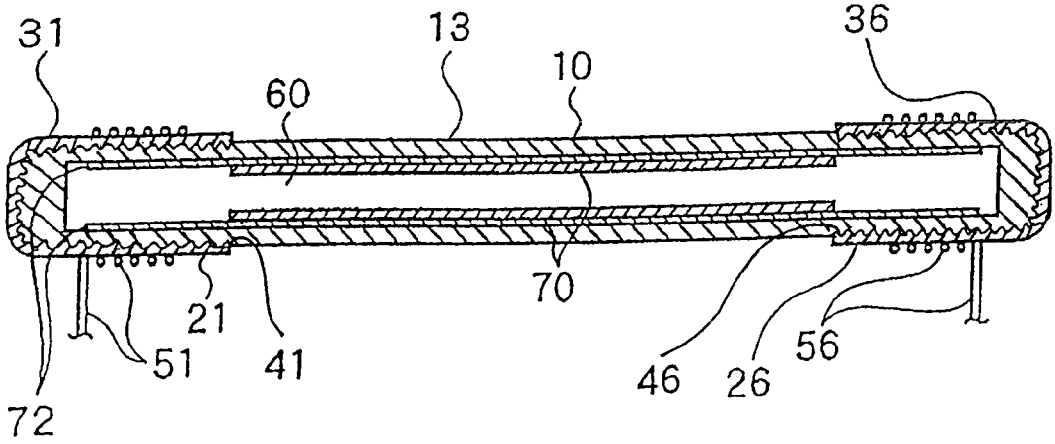
FIG. 5 is an axial cross sectional view of the dielectric barrier discharge type low-pressure discharge lamp according to a fifth embodiment of the present invention.

FIGS. 4 and 5 are drawings showing a fourth and a fifth embodiments according to the dielectric barrier discharge type low-pressure discharge lamp of the present invention. In a low-pressure discharge lamp 12 shown in FIG. 4, the blasted surfaces 41 and 46 are formed on the outer surfaces of both ends of the tubular glass lamp vessel 10, similarly to the third embodiment shown in FIG. 3, and the ultrasonic solder dipping layers 31 and 36 are formed on the surfaces thereof. Furthermore, a metal oxide layer 71 such as aluminum oxide, yttrium oxide, or zinc oxide is formed on a phosphor layer 70 in the tubular glass lamp vessel 10 and on the glass surfaces inside the external electrodes 21 and 26.

In the low-pressure discharge lamp 12 having such a construction, the ultrasonic solder dipping method is adopted, thus mass production of a highly efficient low-pressure discharge lamp can be realized at a low price as in the low-pressure discharge lamp 11 according to the second embodiment. Furthermore, according to the embodiment, silver consumption due to adsorption of mercury into the phosphor layer 70 in the glass lamp vessel 10 can be suppressed and silver consumption due to entry of silver into the glass can be prevented. Thus a life span of the lamp can be lengthened.

Next, in a low-pressure discharge lamp 13 shown in FIG. 5, the blasted surfaces 41 and 46 are formed on the outer surfaces of both ends of the tubular glass lamp vessel 10, and the ultrasonic solder dipping layers 31 and 36 are formed as external electrodes 21 and 26 on the surfaces thereof, as in the third embodiment. Further, a metal oxide layer 72 such as aluminum oxide, yttrium oxide, or zinc oxide is formed between the inner surface of the tubular glass lamp vessel 10 and the phosphor layer 70 and on the glass surfaces inside the external electrodes 21 and 26.

In the low-pressure discharge lamp 13 having such a construction, the ultrasonic solder dipping method is adopted, thus mass production of a highly efficient low-pressure discharge lamp can be realized at a low price similarly to the low-pressure discharge lamp 11 of the second embodiment. Furthermore, according to the embodiment, silver consumption due to entry of silver into the glass surface of the tubular glass lamp vessel 10 can be prevented and a life span can be lengthened.

Further, in the fourth and fifth embodiments, the case using the low-pressure discharge lamp 11 according to the second embodiment is explained. However, it is needless to say that the low-pressure discharge lamp 11 of the first or third embodiment may be used.

The present invention is not limited to the aforementioned embodiments and can be modified variously. For example, the coiled lead wires 51 and 56 are installed on the both ends of the tubular glass lamp vessel 10, on which the solder dipping layers 30 and 35 or the ultrasonic solder dipping layers 31 and 36 are formed. However, they may not be always coiled lead wires if conductors can make contact with the solder dipping layers.

As explained above using various embodiments, the low-pressure discharge lamp according to the present invention, conductor layers composed of a uniform and even metal deposit can be formed as external electrodes 21 and 26 of the tubular glass lamp vessel 10. Further, the blasted end surfaces 41 and 46 of the tubular glass lamp vessel 10 are dipped into the solder bath, thus conductor layers very hardly separable from the tubular glass lamp vessel 10 can be formed. Therefore, a highly efficient low-pressure discharge lamp having a stable discharge characteristic at low power consumption can be obtained. Moreover, it can be manufactured by a comparatively easy art such as solder dipping, so that mass production can be realized and the cost of the low-pressure discharge lamp can be reduced.

What is claimed is:

1. A method for manufacturing a low-pressure discharge lamp, comprising steps of:

preparing a fused solder bath having a main component of either one of an alloy of tin and indium or an alloy of tin and bismuth, dipping an end of a tubular glass lamp vessel into the fused solder bath, and forming solder dipping layers on the end of the tubular glass lamp vessel used for an external electrode.

2. A method for manufacturing a low-pressure discharge lamp according to claim 1, further comprising a step of blasting a surface of the end of the tubular glass lamp vessel before dipping the ends of the tubular glass lamp vessel into the fused solder bath.

3. A method for manufacturing a low-pressure discharge lamp according to claim 2, wherein the fused solder contains at least one of antimony, zinc, or aluminum as an additive.

4. A method for manufacturing a low-pressure discharge lamp according to claim 3, wherein the fused solder contains no lead component.

5. A method for manufacturing a low-pressure discharge lamp, comprising steps of:

preparing a fused ultrasonic solder bath having a main component of either one of tin, an alloy of tin and indium, or an alloy of tin and bismuth, dipping an end of a tubular glass lamp vessel into the fused ultrasonic solder bath with ultrasonic vibration, and forming an ultrasonic solder dipping layer on an end of the tubular glass lamp vessel used for an external electrode.

6. A method for manufacturing a low-pressure discharge lamp according to claim 5, wherein the ultrasonic solder contains at least one of antimony, zinc or aluminum as an additive and contains no copper or silver.

7. A method for manufacturing a low-pressure discharge lamp according to claim 6, wherein the ultrasonic solder contains no lead component.

8. A method for manufacturing a low-pressure discharge lamp according to claim 5, further comprising steps of:

blasting a surface of an end of a tubular glass lamp vessel before dipping the end of the tubular glass lamp vessel into the fused ultrasonic solder bath.

9. A method for manufacturing a low-pressure discharge lamp according to claim 8, wherein the ultrasonic solder contains at least one of antimony, zinc or aluminum as an additive.

10. A method for manufacturing a low-pressure discharge lamp according to claim 9, wherein the ultrasonic solder contains no lead component.

* * * * *